United States Patent [19]

Schloesser et al.

[11] Patent Number: 4,911,317

[45] Date of Patent: Mar. 27, 1990

[54] CONTROLLED ENVIRONMENT STORAGE SYSTEM

[75] Inventors: Robert P. Schloesser, West Bloomfield; Steven G. Hocking, Livonia, both of Mich.

[73] Assignee: AAR Corporation, Elk Grove Village, Ill.

[21] Appl. No.: 233,524

[22] Filed: Aug. 19, 1988

[51] Int. Cl.[4] ..... B65D 88/00

[52] U.S. Cl. ..... 220/1.5; 220/85 B; 53/434; 53/469

[58] Field of Search ..... 53/459, 469, 434, 472; 220/1.5, 85 B; 222/386.5

[56] References Cited

U.S. PATENT DOCUMENTS

| | | | |
|---|---|---|---|
| 4,516,906 | 5/1985 | Krein | 220/85 B |
| 4,583,347 | 4/1986 | Nielsen | 53/434 |
| 4,671,733 | 6/1987 | Krein | 220/85 B |
| 4,678,389 | 7/1987 | Bonerb | 220/85 B |
| 4,735,457 | 4/1988 | Bonerb et al. | 220/85 B |

OTHER PUBLICATIONS

AAR Brooks and Perkins-Airflex-Passive, Long-Term Storage System-1984-Entire Document.

AAR Brooks and Perkins-Airflex Shelters, Containers Solve Storage Problems in Adverse Conditions-May, 1987-Entire Document.

*Primary Examiner*—A. Michael Chambers

*Attorney, Agent, or Firm*—Harness, Dickey & Pierce

[57] ABSTRACT

A storage system for storing or shipping goods in a controlled environment comprises a bag made of a flexible gas and water impermeable material placed in an ISO type shipping container, with the bag having an entry flap equivalently sized with and positioned adjacent to the door of the container with an air and water resistant zipper sealing the flap with the bag, and having a resealable port for inflating and evacuating the interior of the bag. A method of using the storage system is also disclosed.

31 Claims, 3 Drawing Sheets

FIG. 1.
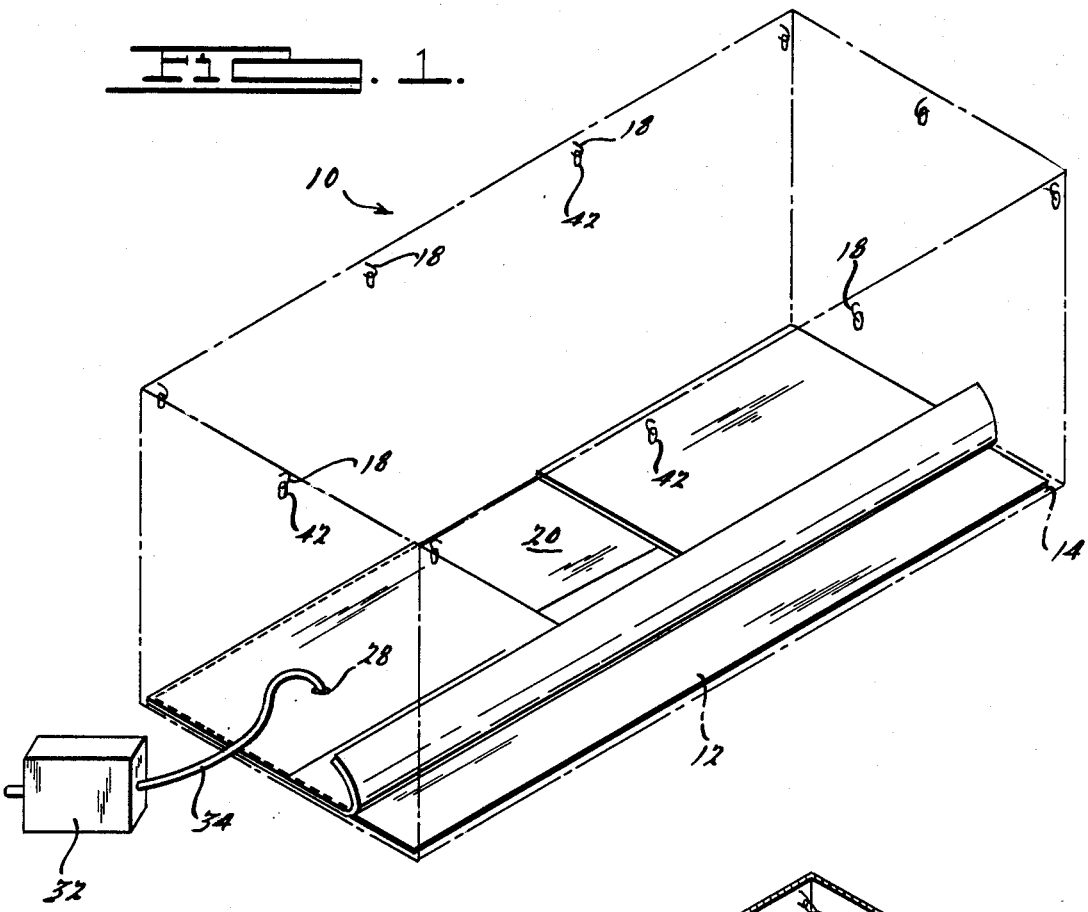
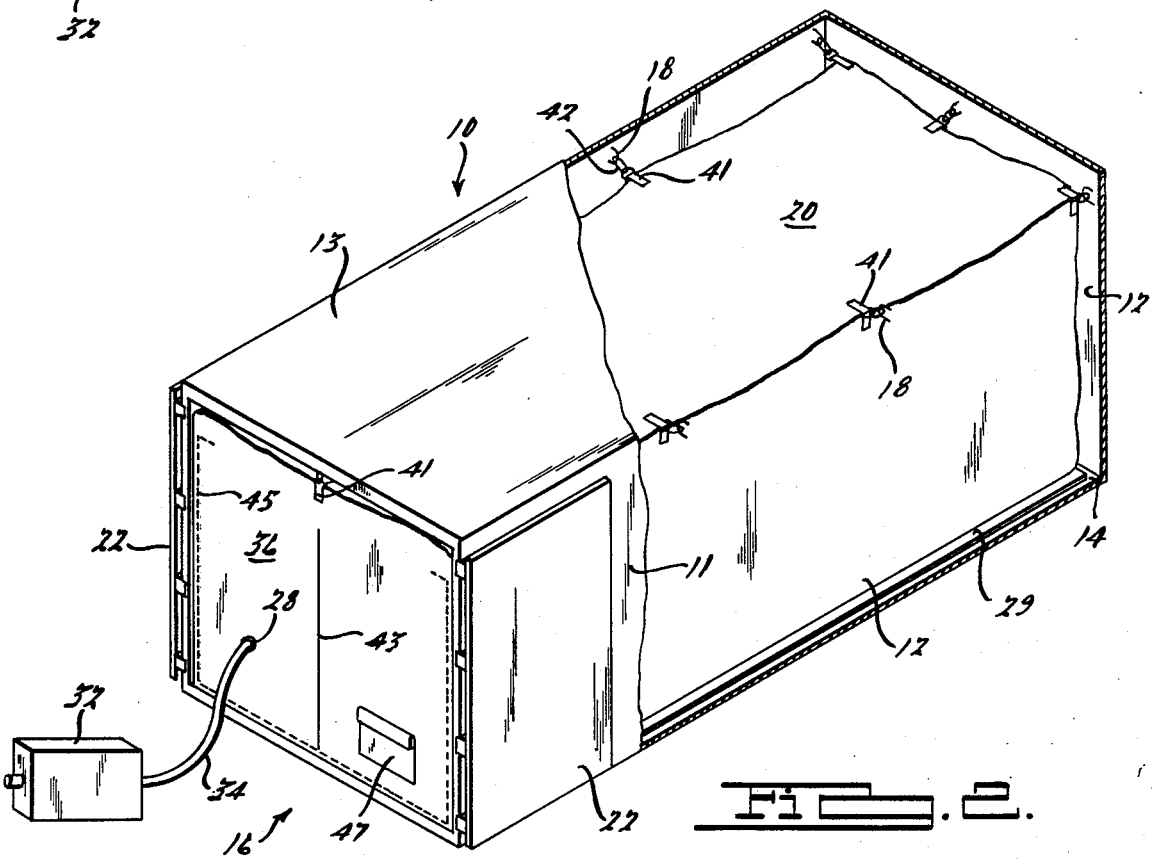
FIG. 2.

FIG. 3.
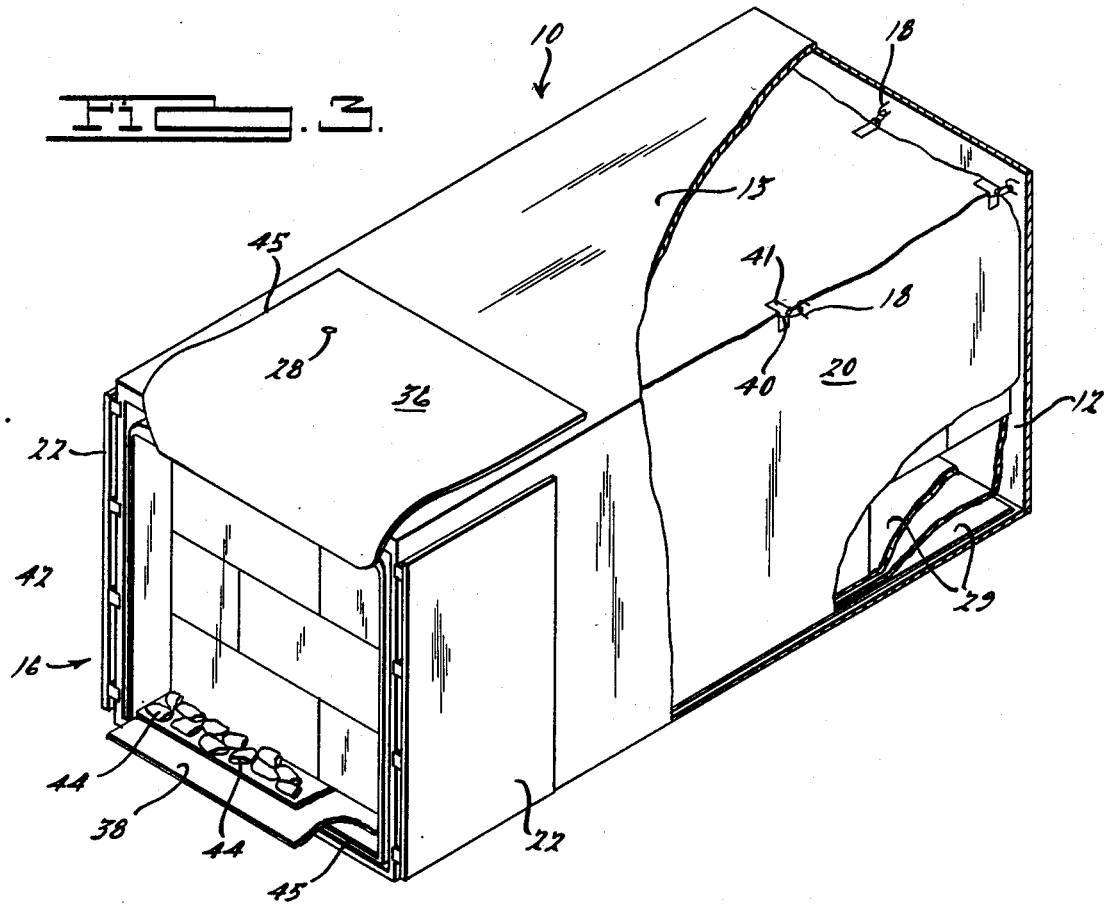
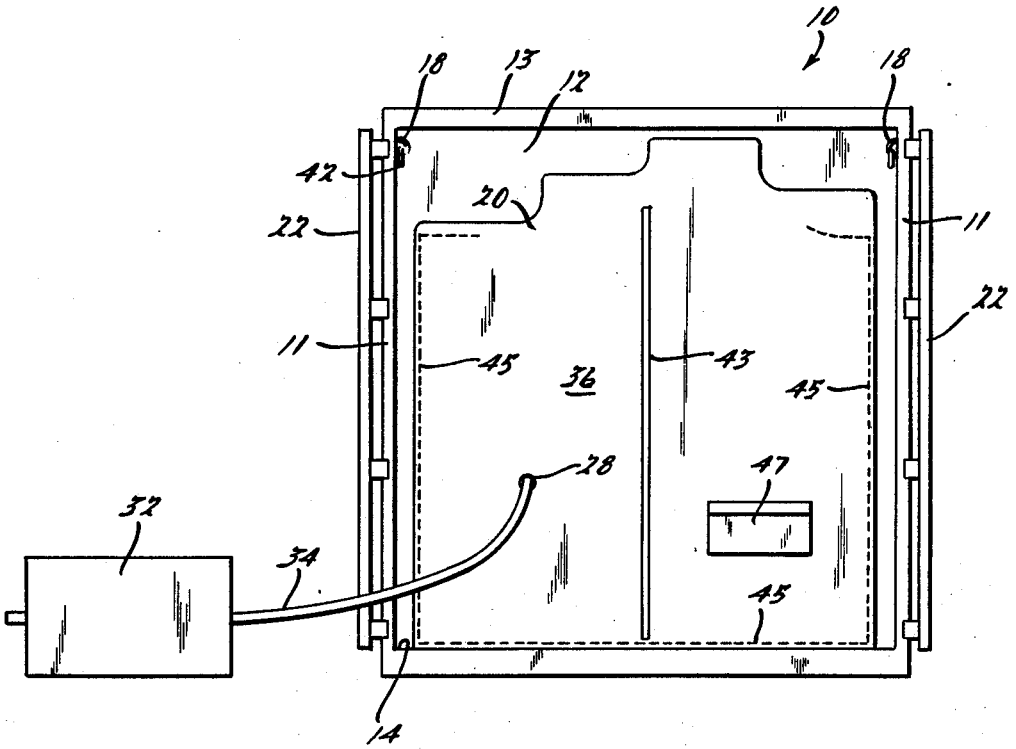
FIG. 4.

CONTROLLED ENVIRONMENT STORAGE SYSTEM

FIELD OF THE INVENTION

The present invention relates to a storage system in which goods are maintained in a controlled environment for storage or shipping, and in particular, to a controlled environment storage system which can be utilized with a typical ISO shipping container to obtain a reduced humidity and contamination free environment for goods held therein.

BACKGROUND OF THE INVENTION

Typical containers which are utilized to store goods or ship goods by truch or boat, such as a typical ISO type container, are often exposed to dirt, dust, gaseous and other contaminants, moisture, humidity and adverse environmental conditions. This often has an undesirable effect on the goods held within the container. For instance, the goods may become damp resulting in corrosion, mildew or deterioration. With certain types of goods this may also cause a fire hazard. Exposure to the goods of dust and dirt clearly is undesirable. Humidity and changing temperatures can result in condensation forming with the container or on the goods held therein, which mositure is trapped within causing damage to the goods. This is particularly true in the containers of a metal, such as steel, or when the goods are constructed of a metal and not well packaged.

Systems have been devised to protect goods from the above-mentioned problems in exposure situations, the most pertinent example of which is likely the Airflex® shelter, manufactured by AAR Brooks & Perkins of Livonia, Mich. The Airflex shelter comprises a floor sheet material upon which the article is positioned. The article is then covered with a strong, flexible polymer material, having an inflatable seal attached around the edge of the cover material. A perimeter frame is constructed around the article adapted to received the inflatable seal. The floor material and inflatable seal of the cover are inserted therein and the seal inflated forming a water resistant seal between the cover and floor material about the article held within. The cover and base floor sheet thus form an air and water tight shelter within which the article is held. Air within the shelter is then evacuated to partially remove the air within the shelter and draw the cover material around the article. A desiccant material has been placed within the shelter to absorb residual moisture remaining within the shelter. The shelter thus provides an enclosed, low humidity storage environment for articles contained within.

A related system is the Airflex® container which is constructed in a similar manner to the shelter described above. The Airflex® container comprises a structural base member which has pallet-type characteristics and a receptacle for the inflatable seal in which a cover material is sealed in a manner similar to that described above. Wire screened sides and a sheet metal top are attached to the base to provide security, impact protection and a means of stacking the Airflex containers. The space defined within the cover when sealed to the base is again evacuated to remove air and moisture, drawing the cover around the article placed therein.

While these above-described systems are very effective at maintaining a contamination and humidity free environment in an exposed condition, their use in an enclosed container, such as the ISO container which generally has a singular opening for entrance and solid walls, can be improved, particularly from the standpoint of installation and assembly. Furthermore, since an enclosed container removes the storage system from exposure to sunlight and weather elements, different materials may be utilized which may improve sealing capabilities.

SUMMARY OF THE INVENTION

A storage system for storing or shipping goods in a controlled environment is provided which comprises a container having solid walls and generally a singular entry way, such as a door. A typical container of this type would be described as an ISO type container. No modification of the container is necessary. A bag or membrane is installed and positioned within the container. The bag has a portion which provides an opening which cooperates with the opening into the container to place goods therein. Preferably, the opening into the bag is defined by a flap formed in the material of which the bag is made, which includes air and water resistant closure means for sealing the flap to the bag and the interior space within the bag when the flap is closed. The bag is constructed of a flexible air and waterproof material such as butyl rubber, to provide a barrier to contaminants, air and water for goods placed therein. The adverse effects of condensation and resulting mildew, rust and corrosion are virtually eliminated for years. Furthermore, the bag is resuable and repairable, and should be usable for 10–20 years.

A resealable port is provided in a surface of the bag which permits attachment of a pump so that the interior of the bag can be either inflated or evacuated when closed. The port is advantageous in that it can be utilized in installation and positioning of the bag within the container by pressurizing and inflating the bag so that it can be expanded from a flat folded configuration within the container and attached therein. The port can also be used to remove a large portion of the air and moisture within the bag when closed, drawing the bag closely around the articles placed therein to reduce interior volume and humidity therein.

Residual moisture control is obtained by providing a desiccant material within the storage system beofre it is sealed so that it absorbs residual moisture after the storage system has been evacuated.

DESCRIPTION OF THE DRAWINGS

FIG. 1 is a perspective view of the storage system being unfolded within a container, with the container shown in phantom view.

FIG. 2 is a perspective view of a storage container having the bag inflated within the container, with a rear portion of the storage container shown removed and the far side and rearward wall of the storage container shown in place.

FIG. 3 is a perspective view of the storage system with the bag positioned within the container having an entry opening, i.e., the flap, open and articles positioned therein, and with a rearward portion of the container cut away to expose the bag, and further with a rearward portion of the bag cut away to show the flooring materials. Note also a portion of a front lip is cut away to show it covering the bag flap closure.

FIG. 4 is a rear view of the storage system depicting the bag within the container having the entry way closed and being evacuated and drawn in tight upon articles placed therein.

DETAILED DESCRIPTION OF THE INVENTION

Figure 5:
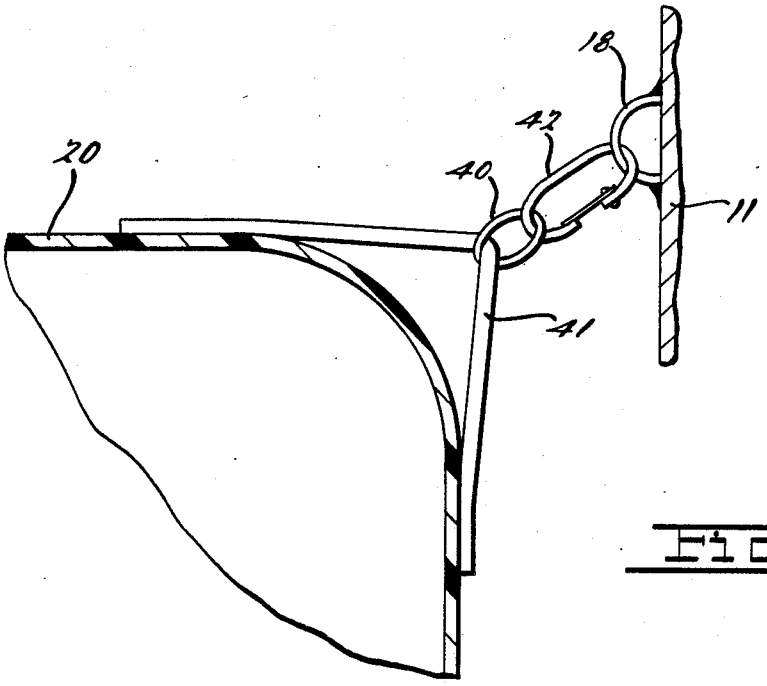
FIG. 5 is an enlarged vertical section view showing how the bag is temporarily connected to the container.
Figure 6:
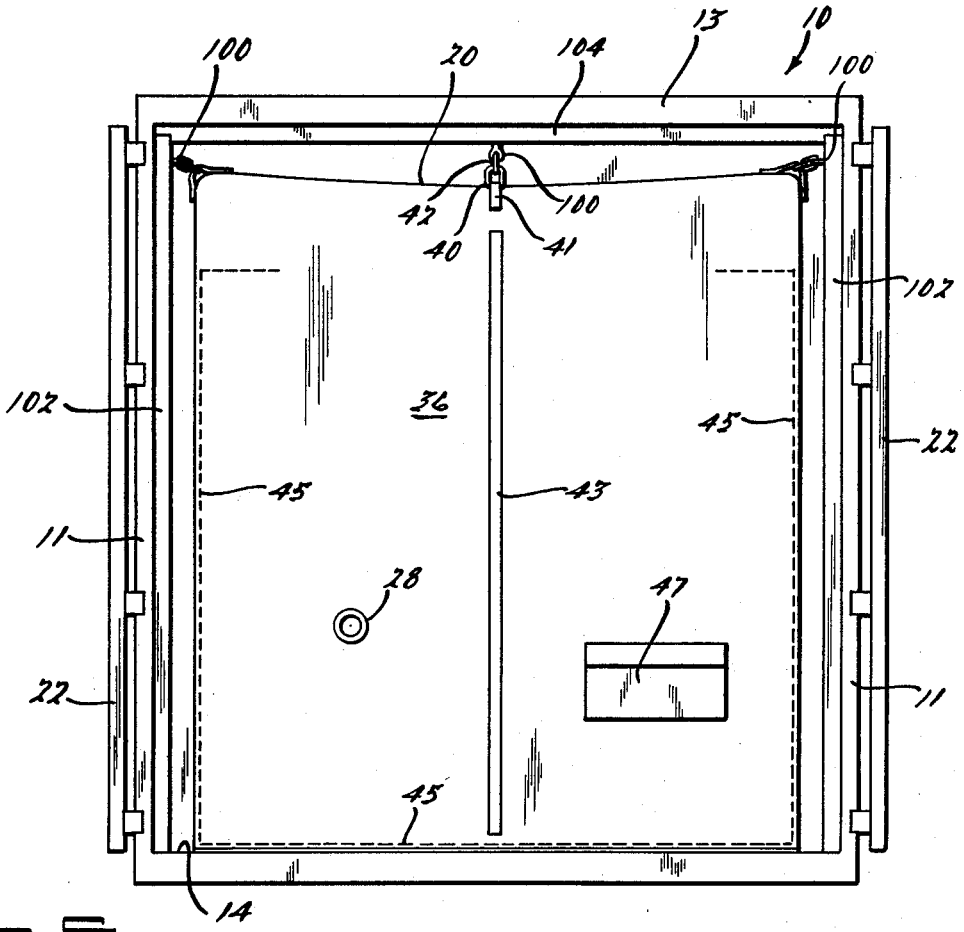
FIG. 6 is a rear view of an alternative embodiment of the storage system of the present invention.

The invention which is disclosed is a storage system for storing or shipping goods in a controlled environment, and is generally shown in FIGS. 1 and 2. A container 10, which is preferably an ISO-type container, is shown in phantom view in FIG. 1 and partially shown in FIG. 2. The storage system comprises a bag or membrane 20 placed within the container 10 which is utilized to provide protection and a controlled environment for the goods contained therein.

The container 10, which is depicted as an ISO-type container in the drawings, generally has an elongate, rectangular configuration with solid side walls 11, one solid end wall 12, a ceiling 13 and a floor 14, all constructed of steel, but often with a wood liner on the floor. Access into the container 10 is provided through an entry opening 16 at the other end having doors 18 hinged to the sides of the container. Eyelets, rings or hooks 18 are normally placed along the inside walls 12 of container 10 near the ceiling to provide means for securing goods placed therein. In a twenty foot container, for example, there may be four such anchoring devices on each side and one on each end wall.

The bag 20 is installed and positioned within the interior of container 10 fully surrounding the interior space defined therein. The bag 20 is constructed of a flexible gas and fluid impermeable material such as solid butyl rubber sheeting and preferably is constructed of a minimum of two plies of such sheeting. Butyl rubber is preferred because it is highly moisture resistant and also resistant to various gases and contaminants. An example of the compound material in which the bag may be constructed is A.B. Varnamo Gummifabrik Compound E2709. Such material provides the physical properties described in the following chart.

| Physical Properties | Requirement |
|---|---|
| Specific Gravity Test per ASTM-D-297-81 Sect. 15, Para. 1.2 | 1.19 +/− .02 |
| Tensile Strength Test per ASTM-D-412-80 Die C. | 1300 PSI Min. |
| Elongation at Break Test per ASTM-D-412-80 Die C. | 350% Min. |
| Tear Resistance test per ASTM-D-624-81 Die B. | 150 Lbs. per inch Min. |
| Hardness IHRD Test per ASTM-D-1415-81 | 65° +/− 5° |
| Heat Aging Test per ASTM-D-573-81 Type II "A" Ovens 168 Hours @ 121° C. +/− 1° C. | Change of Tensile Strength −35% Max. Change of Elongation At Break −40% Max. |
| Ozone Resistance Test per ASTM-D-1149-78A 96 Hours, 30° C., 50PPHM, 80% Elongation | No cracking |
| Water Vapor Transmission Test per ASTM-E-96-66 Procedure E. 38° +/−.5° C., 90% +/− 2% R.H., 24 hours | .23 Grams per Square Meter, 24 hours |
| Flexiblity Test per ASTM-D-2137-75 Method B −35° C. +/− 126° C. | Remain Flexible |
| Water Absorption Test per ASTM-D-471, 7 days @ 158° F. | Increase in Weight 1.3% Max |
| Water Absorption Test per ASTM-D-471, 7 days @ 158° F. | Increase in Volume 2.0% Max |

The various components of the bag may be secured together using conventional technology. For example, multiple pieces of butyl rubber laminate may be affixed to one another to form the bag by placing a strip of uncured butyl rubber tape therebetween and thereafter applying heat and pressure to vulcanize the pieces in a leakproof manner.

An entry way, which in the preferred embodiment is a flap 36 defined in the bag 20, cooperates with the entry opening 16 of the container 10 to permit access for goods to be place therein. The flap portion 36 is separated from the bag 10 along two sides and the bottom while the top remains integrally connected to the bag along its top region so that the flap can be folded back over the top of container 10, as shown in FIG. 3. The flap 36 is sized to conform with opening 16 of the container 10. This permits easy access into the interior of the storage system, without need of retaining the flap portion out of the way so that it does not impede entry into the bag 20 and container 10.

The flap 36 has a closure means, preferably a zipper 45, which is resistant to the passage of air and moisture, for fastening and sealing the flap to the remaining portions of the bag 20 when the bag is closed. A zipper of a useable type is described in U.S. Pat No. 4,275,467 and available from the New Zipper Company Limited of Slough, England under Product Description Number 6BDM Sealed Slide Fastener Closed Both Ends. The zipper is constructed of bronze metal and has butyl rubber or neoprene flanges for sealing and attachment to the bag. The zipper may be affixed to the bag in the same manner as the various other components thereof, i.e. by vulcanization. If desired, a pouch 47 may be affixed to the outside of flap 36 to retain an instruction manual and a patch kit to repair the bag should it become damaged.

The bag 20 is also provided with a flap or lip 38 which may be unfolded and extended over the lower portion of the closure means of the flap 36 for protection of the latter. This is shown in FIG. 3. The flap 38 may be constructed of multiple plies of butyl rubber sheeting and scrim laminated together, and is bonded to the floor of the bag. 20. Additionally, a first sheet 29 of PVC material may be positioned below the bottom portion of the bag, between the bag 20 and the floor 14 of the container 10, and a second sheet 29 within the bag 20 on the floor surface to assure the material of which the bag is constructed is not damage when loading goods within the bag and container. The PVC material may be flexible or semi-flexible, and in the preferred embodiment is a PVC coated polyester material referred to as Staftex 6517, available from Stafford Textiles Limited, Toronto, Canada.

A plurality of eyelets 40 are attached to the exterior of the bag 20 in cooperating relationship with eyelets 18 within the interior of the container 10, so that snap hooks 42 may be utilized to temporarily connect the eyelets 18 and 40 together to retain the bag in an open loading configuration within the interior of container 10. Eyelets 40 may be affixed to bag 20 by means of straps 41 formed of butyl rubber and scrim laminated together, the straps being bonded to the bag by vulcanization or the like.

A resealable air port with closure 28 is mounted through the material of which the bag 20 is constructed. The port 28 is utilized to pass air into and out of the interior of the bag 20 when the flap 36 is closed and the bag is sealed. This can be accomplished by means of a pump 32, connected to the port by hose 34. This permits the bag 20 to be inflated to assist in the installing and positioning of the bag 20 within the interior of the container 10. Further, after the goods are placed within the storage sytem, it permits evacuation of air from the interior of the bag to reduce air volume and moisture content therein. As the bag is evacuated it will be drawn closely around the articles placed therein as depicted in FIG. 4, providing a reduced volume and reduced humidity environment for the goods contained therein. In the preferred environment, the port 28 is placed through flap 36 of the bag 20, providing easy and unobstructed access for hose 34. This is shown in FIGS. 2 and 4. The closure cap for the part may be solid or may hold a visible humidity indicator disk.

A plurality of bags of desiccant material, generally shown at 44 FIG. 3, are placed within the interior of the bag 20 prior to closing and sealing of the flap 36. The desiccant material 44 will assure that residual mositure within the bag 20 after evacuation is absorbed. The goods contained within the bag and container storage system are thus maintained in a reduced humidity environment to prevent the problems heretofore discussed.

The procedure for installation and positioning of the bag 20 within the container 10 can be described beginning with FIG. 1. First, a sheet 29 of PVC plastic is placed on the floor of container 10 to protect the bottom of bag 20. The bag 20 is unfolded along the length of floor 12 into the container 10 and then unfolded outwardly towards the walls of the container 10 until it substantially covers the floor. The bag 20 is centered within the interior of container 10 with the assistance of a centering strip 43 on the front of the bag. The pump 32 is connected to the port 28 to provide air flow into the bag to pressurize its interior so that the bag is expanded. This is obviously accomplished with the flap 36 closed and sealed. When the bag 20 is inflated, snap hooks 42 are manually used to attach each eyelet 40 to a corresponding eyelet 18 on the container (FIGS. 2 and 5). The flap 36 is located to center itself within the opening 11 of container 10 so that the interior of bag 20 is entirely accessible. Once the bag 20 is fully inflated and properly anchored to eyelets 18, so that the upper portion of the bag will be maintained in an expanded position without being pressurized, pump 32 is disconnected from port 28, the pressure relieved, and the flap 36 opened by unfastening zipper 45.

Next, as best seen in FIG. 3, the flap 36 is folded over the top of container 10 and lip 38 is extended over the lowermost portion of the opening in the bag 20 to protect zipper 45 during the loading of articles into the storage system. A sheet 29 of PVC is placed on the floor of the interior of the bag 20 to protect the bottom surface of the bag. Cargo and articles are then placed within the interior of the storage system, inside the bag. Once loading has been completed, bags 44 of desiccant material are placed within the interior of the bag 20 to assist, as described above, in moisture reduction within the bag once it is sealed. The flap 36 is folded down from over the top of container 10, the zipper is fastened to seal the interior volume of the bag 20.

The pump 32 is again attached through hose 34 to the resealable port 28 and the interior volume of the bag is now evacuated so that it is drawn closely around the articles contained therein. A large portion of the air and mositure contained within the air in the bag is removed through evacuation, although the pressure differential of evacuation is very small, i.e., that obtainable with a conventional vacuum cleaner. This is shown in FIG. 4 where the upper portions of the bag have drawn around the articles placed therein. Once the bag has beeen sufficiently pumped down and the hose 34 removed, the post 28 is sealed. The doors 13 of the container 10 are then closed. Storage of the articles placed within the storage system is then complete.

If the container 10 is not provided with eyelets or other suitable arrangements to attach snap hooks to the upper portion thereof, wooden supports having eyelets at one end may be supplied with the bag to be placed along the interior sides of container 10 so that the bag can be supported during loading. As shown in FIG. 5, this can be simply accomplished by providing an eyelet 100 adjacent the top of a pair of properly sized wood two-by-four braces 102, which are propped against the wall of the interior of the container 10 on opposite sides thereof. In this arrangment the bag eyelets 40 would be manually attached to the eyelets 18 on the wood braces using snap hooks 42. If desired, braces 102 can also be held in place by using an additional wood two-by-four strut 104 extending transversely across the top of the inside of the container and having its ends affixed to the top of braces 102 in any suitable manner. The method of using the system is otherwise the same as described in connection with the first embodiment.

While it is apparent that the preferred embodiment of the invention disclosed above are well calculated to achieve the objects of the present invention, it will be appreciated that the invention is susceptible to modification, variation and change without departing from the proper scope or fair meaning of the subjoined claims.

I claim:

1. A storage system for shipping and/or storing goods in an environmentally controlled enclosure, said system including:

(a) a rigid container having a first entry means for accessing the enclosed space therein;

(b) enclosure means disposed in said container having second entry means for accessing and sealing the enclosed space therein and cooperating with said first entry means to permit goods to be place within said enclosure means, said enclosure means comprising a flexible gas and fluid impermeable material;

(c) said enclosure means comprising holding means positioned at certain intervals along said enclosure means for connecting said enclosure means to said rigid container to permit access to the enclosed space therein; and (d) means defining a resealable port in said enclosure means whereby the latter can be inflated and evacuated.

2. A storage system as set forth in claim 1 wherein said container is generally rectangular in plan and said first entry means is a door providing access through one end of said container.

3. A storage system as set forth in claim 2 wherein said container is a standard ISO-type container.

4. A storage system as set forth in claim 1 wherein said enclosure means is a bag substantially filling the space within said container.

5. A storage system as set forth in claim 4 wherein said second entry means for said enclosure means is resistant to passage of air and moisture, and provides a seal therefor.

6. A storage system as set forth in claim 5 wherein said second entry means is an opening formed in said bag having closure means for closing the interior space within said bag and providing an air and moisture resistant seal, positioned adjacent to the first entry means of said container.

7. A storage system as set forth in claim 6 wherein said opening is a flap formed in said bag adjacent the first entry means in said container and having said closure means extending thereabout.

8. A storage system as set forth in claim 7 wherein said flap is formed in said bag so that it provides an opening along the sides and bottom of said flap adjacent said first entry means, said closure means is a zipper extending around the opening defined by said flap.

9. A storage system as set forth in claim 6 wherein said closure means is a zipper extending around said opening formed in the bag.

10. A storage system as set forth in claim 9 additionally comprising means to protect said zipper extending along the bottom portion of the opening formed in said bag over which goods are transported into said bag.

11. A storage system as set forth in claim 1 wherein said enclosure is constructed of an elastomeric material.

12. A storage system as set forth in claim 11 wherein said material is butyl rubber.

13. A storage system as set forth in claim 12 wherein said material comprises at least 2 plies of butyl rubber material.

14. A storage system as set forth in claim 1 further including means for desiccating the interior space of said container comprising a desiccant material disposed within said enclosure means.

15. A storage system as set forth in claim 1 wherein said holding means comprises a plurality of ring-like fittings attached along the upper portion of said enclosure means and adapted to be connected to said container.

16. A storage system as set forth in claim 15 further comprising a plurality of braces adapted to be propped upright in said container along the walls thereof, each of said braces having a fastening device affixed adjacent the upper end thereof when in use to which said ring-like fittings can be attached.

17. A storage system as set forth in claim 16 further comprising a plurality of struts adapted to be connected to opposed braces at the upper end thereof to help support same.

18. A storage system as set forth in claim 17 further comprising a plurality of snap hooks for manually connecting said ring-like fittings to said container.

19. A storage system as set forth in claim 1 wherein said second entry means comprises a generally rectangular flap in said enclosure means, said flap being generally coincident with said first entry means.

20. A storage system as set forth in claim 19 wherein said flap is integral with said enclosure means along the top of said first entry means.

21. A storage system as set forth in claim 20 wherein the remaining bottom and side peripheral edges of said flap are sealingly secured to said enclosure means by a zipper.

22. A storage system as set forth in claim 21 further comprising a second flap overlying the zipper on said bottom peripheral edge.

23. A storage system as set forth in claim 1 additionally comprising a loose piece of material disposed within said enclosure means covering the bottom floor surface thereof.

24. A storage system as set forth in claim 23 wherein said piece of material is constructed of an elastomeric material.

25. A storage system as set forth in claim 24 wherein said material is polyvinylchloride.

26. A storage system as set forth in claim 1 wherein said enclosure means has centering indicia along the outward side adjacent said first entry means of said container so that said enclosure means can be centered within said container during installation and positioning.

27. A storage system as set forth in claim 1 wherein, said resealable port is located in said flap and said resealable port includes a removable visible humidity indication device.

28. In a storage system for storing or shipping goods, having a container in which goods are held, said container having an entry door permitting access to the enclosed space therein, a method of utilizing a flexible gas and fluid impermeable enclosure means within said container to provide a controlled environment storage system, said method comprising the steps of:

laying said enclosure means on the floor of said container in a folded state;

unfolding said enclosure means on the floor of said container generally centering said enclosure means within said container;

applying air under pressure to the interior of said enclosure means to inflate same within the interior of said container;

anchoring select points on said enclosure means to fixed positions within said container;

depressurizing the interior of said enclosure means by unfastening closure means along three edges of an opening in said enclosure means to form a flap in the opening of the enclosure means;

folding the flap away from the opening such that the opening forms an entry way of substantially the same size as the entry way of the container;

filling the interior of said enclosure means within said container with goods;

closing the entry way of said enclosure means by fastening the closure means about said entry way to provide an air and moisture resistant seal for the interior of said enclosure means;

evacuating air from said enclosure means to draw said enclosure means around goods held therein; and closing said container door.

29. A storage system as set forth in claim 28 comprising the further step of placing a desiccant in said enclosure means prior to evacuating same.

30. A storage system as set forth in claim 29, further comprising laying down a sheet of plastic material over the floor area in said enclosure means before filling same with goods.

31. The method as set forth in claim 29 further comprising an initial step of laying down a sheet of plastic material over the floor of said container prior to laying said enclosure means on said floor.

* * * * *

UNITED STATES PATENT AND TRADEMARK OFFICE

CERTIFICATE OF CORRECTION

PATENT NO. : 4,911,317

DATED : March 27, 1990

INVENTOR(S) : Robert P. Schloesser and Steven G. Hocking

It is certified that error appears in the above-identified patent and that said Letters Patent is hereby corrected as shown below:

Column 1, line 16, "truch" should be -- truck --.

Column 1, line 40, "received" should be -- receive --.

Column 2, line 46, "beofre" should be -- before --.

Column 2, line 61, after "flap" delete -- , --.

Column 3, line 25, "18" should be -- 22 --.

Column 5, line 12, "sytem" should be -- system --.

Column 6, line 21, "5" should be -- 6 --.

Signed and Sealed this

Twenty-third Day of July, 1991

*Attest:*

*Attesting Officer*

HARRY F. MANBECK, JR.

*Commissioner of Patents and Trademarks*